United States Patent [19]

Mann

[11] 4,215,601

[45] Aug. 5, 1980

[54] FLEXIBLE SHAFT TOOL HEAD

[76] Inventor: Steven R. Mann, P.O. Box 477, Eagle, Colo. 81631

[21] Appl. No.: 21,096

[22] Filed: Mar. 16, 1979

[51] Int. Cl.[3] ..... B25B 17/00

[52] U.S. Cl. ..... 81/57.13; 81/58.1

[58] Field of Search ..... 81/57.13, 57.29, 58.1

[56] References Cited

U.S. PATENT DOCUMENTS

| | | | |
|---|---|---|---|
| 1,698,618 | 1/1929 | Bigelow | 81/57.29 |
| 2,787,180 | 4/1957 | Fish | 81/58.1 |
| 2,808,749 | 10/1957 | Lampke | 81/57.13 |
| 3,430,510 | 3/1969 | Hendrickson | 81/57.29 |
| 3,847,039 | 11/1974 | Azuma | 81/57.13 |

*Primary Examiner*—James L. Jones, Jr.

*Attorney, Agent, or Firm*—Richard D. Law

[57] ABSTRACT

A tool head, for attachment to a flexible shaft drive, including a housing, tool drive connector, start-stop switch, a lock-out ratchet and a connection to a combined flexible shaft and an electric conduit.

5 Claims, 8 Drawing Figures

FLEXIBLE SHAFT TOOL HEAD

BACKGROUND OF THE INVENTION

The use of a remote electric motor to power various tools through a flexible cable drive shaft has been proposed in the past. Such units which are designed for a single purpose, having a single tool, a polisher for example, seem to be satisfactory. Attempts to make a tool head for multiple uses or multiple tools has not been commercially successful.

THE INVENTION

The present invention is directed to a tool head for a flexible shaft motor unit, and particularly to a tool head arranged for use with a plurality of socket wrenches, driven at variable speeds in two speed levels.

The tool head of the invention is arranged for use with a flexible drive shaft combined with an electric cable, so that a remote drive motor may be controlled from the tool head. A manual lock-out provides means for using the tool head as a manual drive for socket wrenches, for example, and the tool head is provided with an easily used switch for two direction rotation of a rotary tool connector, and means for providing a speed control of the electric drive motor.

OBJECTS AND ADVANTAGES OF THE INVENTION

Included among the objects and advantages of the invention is to provide a tool head for a remote electric motor and a flexible drive shaft for powering the tool head.

Another object of the invention is to provide a speed control for an electric motor powering a tool head through a flexible cable.

Still another object of the invention is to provide an easy and quick direction of rotation control of a flexible shaft powered tool head.

Yet another object of the invention is to provide a lock-out ratchet for using the powered tool head as a manual ratchet socket wrench.

An additional object of the invention is to provide a flexible drive shaft combined with an electrical conduit for controlling a remote electric motor for a flexible shaft powered tool head.

These and other objects and advantages of the invention may be ascertained by reference to the following specification and appended illustrations.

GENERAL DESCRIPTION OF THE DRAWINGS

SPECIFIC DESCRIPTION OF THE DRAWINGS

Figure 1:
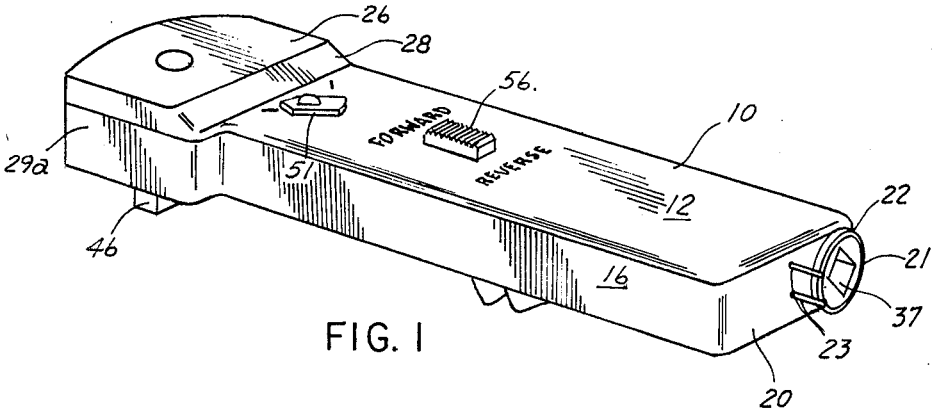
FIG. 1 is a perspective view of a tool head according to the invention.
Figure 2:
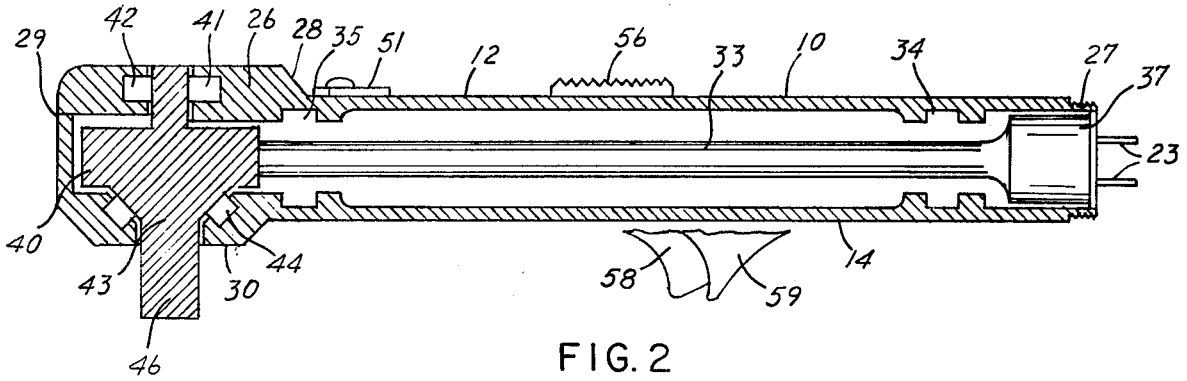
FIG. 2 is a cutaway side elevational view of one form of the invention, showing the drive means for a rotary tool connector.
Figure 3:
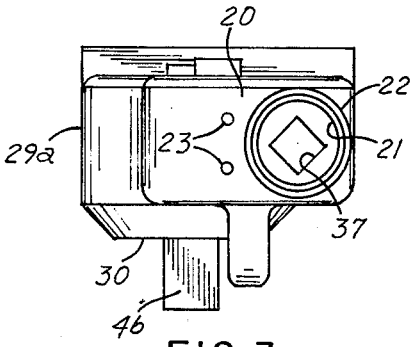
FIG. 3 is an end elevational view of the cable and electric connection of the tool head.

In the device shown in FIGS. 1–4, a housing 10 includes upper 12 and lower 14 walls of an elongated handle section with side walls 16 and 18. An end wall 20 includes a flexible shaft connector 21, which includes a stub support nipple 22, and a two prong electric connector 23. A head section 26 includes a top wall 27 connected by shoulder 28 to the handle section top wall. An arcuate end wall 29 extends around the end of the head section, and a bottom wall 30 closes the bottom of the head section. A drive shaft 33, journalled in bearing sets 34 and 35, extends along the inside of the housing. The shaft includes socket end 37 in the shaft connector 21 opening to the outside of the housing for connecting to a square end drive of a flexible cable (explained below). The shaft 33 includes a worm gear 38 at the opposite end. A worm wheel 40 intermeshed with the worm gear 38, has an upper shaft 41 journalled in bearing set 42, and a lower conical shaft 43 journalled in bearing set 44, has an extending rotary tool holder 46 attached to it, of a ball detent socket wrench holding type. The tool holder extends through the housing for holding socket wrenches, adapters, and the like.

Figure 4:
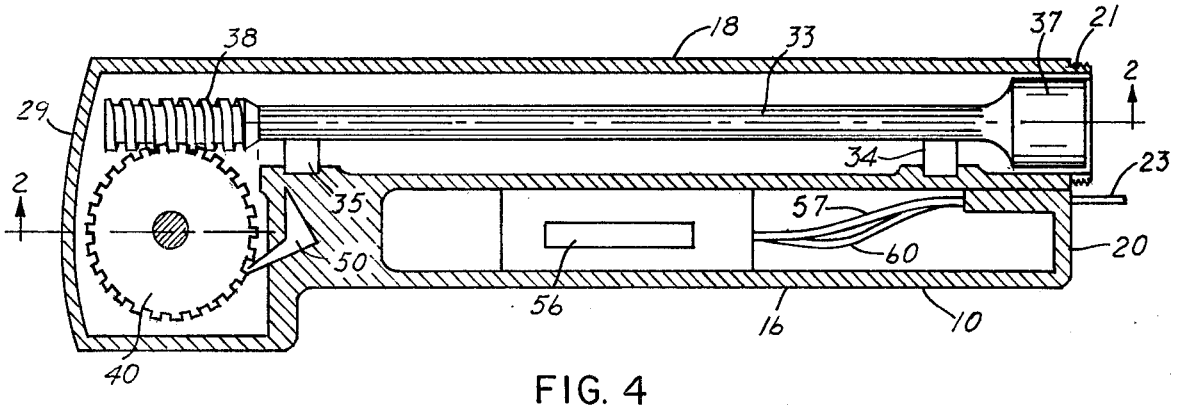
FIG. 4 is a top plan, cross-sectional view of the modification of FIG. 2.

A ratchet pawl 50, FIG. 4, controlled by a pivotal controller 51, external and on top of the housing, is arranged to move with one end or the other into contact with the worm wheel, providing ratcheting of the worm wheel, in either direction, so that the tool head may be used as a manual ratchet wrench for sockets, etc. The controller has three positions, right and left ratchet and off or neutral. In the off position, the worm wheel is free to be rotated by the worm drive. The shaft 41 is open through the top wall for injecting lubricant to the bearings. The lower bearings may be lubricated through the opening between the tool holder and the bottom wall.

A reverse switch 56 connected through leads 57 to the electric connector 23, provides a means for changing polarity in the drive motor for reversing the same. A trigger switch 58, with a guard 59 provides an off-on switch for the motor by means of the leads 60, and a speed control for variable speed motors.

The tool connector may be a standard tool connector with a ball detent to hold a rotary tool on the holder. Such holders are commonly known. Also, the drive 46 may be sized to the size of the tool head and motor, and may be ½, ⅜, or ¼ inch drives. Further, adaptors may be used to change the size of the drive for the tools needed.

Figure 5:
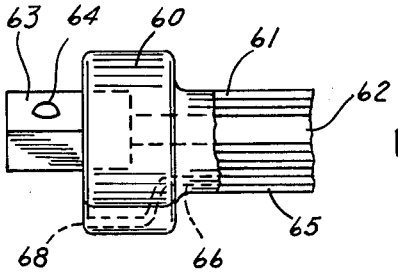
FIG. 5 is an enlarged detail view of the end of a flexible shaft and electric conduit and connecting fittings for a tool head.
Figure 7:
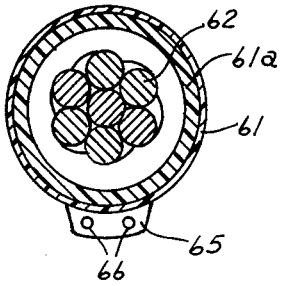
FIG. 7 is a cross-section of the flexible cable-electric conduit combination according to the invention.

The connector fitting, FIG. 5, for the connection to a flexible cable, includes a ferrule 60 attached to the end of sheathing 61 which houses a flexible drive cable 62. The cable terminates in a square drive end 63, with a ball detent 64, arranged to telescope in the socket 37 of the tool head shaft 33. The sheathing, also, includes an integral electrical sheathing 65 for a pair of electrical leads 66 which terminate in a female receptacle fitting 67 having a pair of holes 68 into which the male prong telescopes. The unit may, also, be a three wire circuit as is now standard in the United States. The leads 66 terminate at the other end (not shown) in the power leads for an electric motor to which the flexible shaft is attached. Connection to an electric motor of the flexible cable may be similar to the connection to the head or by other known means. The cable or shaft 62, FIG. 7, may be a solid, flexible shaft (flexible rod) or a woven cable. The sheath 61 may be a coated braided wire, and it may include a rubber or plastic inner liner 61*a*. The liner 61*a* provides a cover for the wire braid preventing rubbing of the cable on the braid. The electrical conduit 65 is integral with the covering of braid. Other configurations and materials may be used to make the combined flexible drive shaft and electric conduit.

Figure 6:
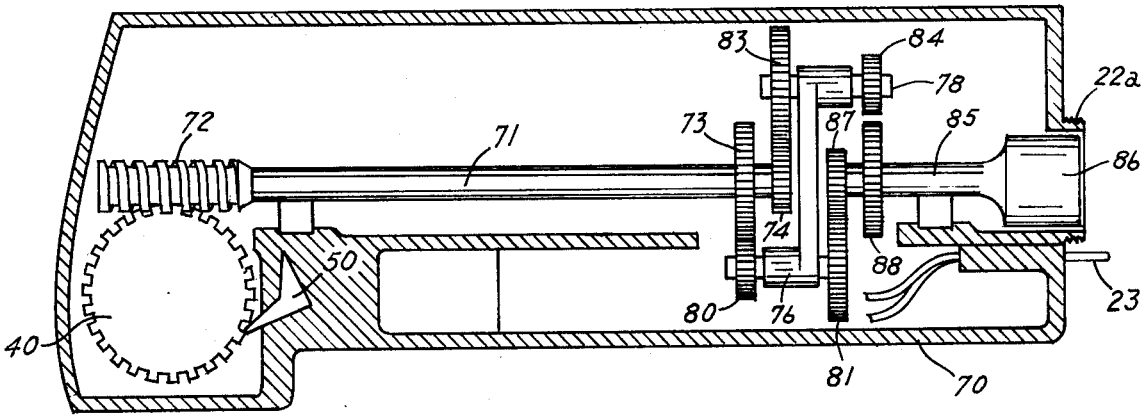
FIG. 6 is a top plan view, in cross-section, of a modified tool head according to the invention.
Figure 8:
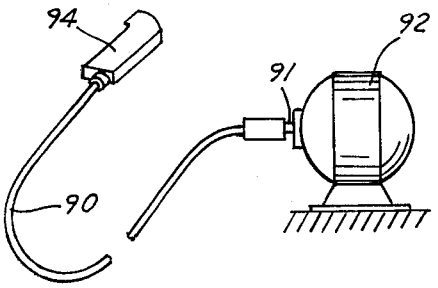
FIG. 8 is a reduced size assembly view of an electric motor, flexible shaft and tool head.

A modified form of the tool head, FIG. 6, includes a gear arrangement to provide a two level speed gearing arrangement, providing two speed ranges apart from the variable speed motor and trigger speed control. Form some purposes as driving screws, hand tightening bolts or nuts for example, the drive usually is accomplished at slow rpms. Long bolts on the other hand, may require high speed, particularly for initial threading the nut on a bolt and light tightening. Thus, the two level speed gearing provides another dimension for the tool head. A housing 70, generally formed similar to that of the single gear speed head, includes a journalled shaft 71 having a worm gear 72 on one end, and a pair of gears on the other. Large gear 73 and small gear 74, mounted on shaft 71, provide driving power for the worm gear. A shaft arrangement includes a laterally movable Z-shaped gear shaft frame 76, which includes shafts 77 and 78. Gears 80 and 81 are splined or otherwise held on shaft 77, and gears 83 and 84 are secured to shaft 78. A shaft 85, with a flexible shaft connector 86, includes drive gears 87 and 88. The shaft frame is arranged for sliding laterally to either engage gear 81 with drive gear 87 or gear 84 with drive gear 88. When gear 87 engages gear 81, shaft 71 is at slow speed through the engaging gears 80 and 73. High speed is obtained by the engagement of gear 88 with gear 84, and gear 83 with gear 74. The ratchet, reversal switch and variable speed trigger arrangement may be the same as that for FIGS. 1–4.

The tool connector is a square drive, however, may be of any desired shape. Also, various tool connectors or adapters may be placed on the tool connector. Previously mentioned is a size adapter for sockets, i.e., ½" drive to e/8" drive, etc. Also, holders for screw drivers, drills, routers, sanding and grinding tools, etc. may be connected to the tool holder. The two speed gearing provides a very adaptable tool to most operations.

In general, a flexible cable 90, manufactured in accordance with the invention, may be connected to shaft 91 of an electric motor 92, which is mounted on a work bench, for example, and a long flexible cable connected between the motor and a tool head 94 may be used with tools necessary for working on an automotive engine, or other work. The length of the cable should fit the particular location. Another arrangement would be a motor located above the work, with the flexible cable extending down to the work with a length to permit tools to be used where needed.

The arrangement of a tool head, flexible shaft and motor provides versatility in tool choice. For example, the motor size may be chosen for the particular job, e.g., heavy duty, high horsepower motor for truck and tractor tools, a light motor for tools for automotive work, and a still lighter motor for tools for lawn mower motors and other small gasoline engines. The various connectors for the tool drive provide versatility for type and size of tool desired, thus giving power-driven tool capability for almost any mechanical repair or maintenance.

What is claimed is:

1. The combination of a tool head and a flexible drive shaft, comprising:

(a) a said tool head including a housing with a journalled shaft having one end connected to the flexible drive shaft and the other end having a gear secured to a rotary tool connector, (b) said tool head having at least one electric switch including a trigger switch operating a remote electric motor and an electric connection receptacle connected therewith, (c) a ratchet pawl mounted in said housing for ratcheting said gear for rotating the rotary connector for manual operation of said tool head, and (d) said flexible drive shaft including a housing for the flexible drive shaft and a housing attached electric conduit providing remote control of said motor to which said tool head and said flexible drive are attached.

2. The combination of claim 1 wherein said housing includes a second electric switch connected to said receptacle for changing polarity of the attached motor for reversing the same.

3. The combination of claim 1, wherein said one end arranged for connection to the flexible drive shaft includes a gear train for providing at least two speed levels for said rotary tool connector.

4. The combination of claim 1, wherein said connection to a flexible drive shaft includes a connector between said journalled shaft and said flexible drive shaft, and releasable housing means securing said shaft housing to said tool head housing.

5. The combination of claim 1, wherein said electric conduit includes a make connector and said housing includes a female receptacle.

* * * * *